United States Patent [19]

Wang

[11] Patent Number: 5,076,572

[45] Date of Patent: Dec. 31, 1991

[54] DRIVING MECHANISM OF AN EXERCISE DEVICE

[76] Inventor: Leao Wang, No. 1, Lane 154, Chang-Long Rd., Tai-Ping, Taichung, Taiwan

[21] Appl. No.: 644,045

[22] Filed: Jan. 22, 1991

[51] Int. Cl.[5] ..... A63B 21/00

[52] U.S. Cl. ..... 272/70; 272/130

[58] Field of Search ..... 272/70, 71, 72, 73, 272/93, 130, 96, 97, 69

[56] References Cited

U.S. PATENT DOCUMENTS 3,727,913 4/1973 Glaser et al. ..... 272/73

4,934,690 6/1990 Bull ..... 272/130

*Primary Examiner*—Stephen R. Crow

*Attorney, Agent, or Firm*—Browdy and Neimark

[57] ABSTRACT

The driving mechanism of an exercise device is disclosed. The mechanism comprises mainly a base seat, two pedals, a connector of H-shaped construction, and two handlebars of an appropriate length to drive the pedals so as to assist both hands of a user in attaining a better coordination of movements.

1 Claim, 5 Drawing Sheets

DRIVING MECHANISM OF AN EXERCISE DEVICE

BACKGROUND OF THE INVENTION

The present invention relates to an exercise apparatus, and more particular to a driving mechanism of an exercise device.

A strengthen-leg exerciser is a popular item used widely for physical fitness by means of coordinated movements of both hands and legs. A prior type, as shown in FIG. 1 and described in U.S. Pat. No. 4,934,690, comprises mainly handlebars and pedals. The insufficient length of the handlebars of the prior art is an apparent drawback, which makes it difficult for users especially those who have short arms, to maneuver properly for coordinated movements.

SUMMARY OF THE INVENTION

A principal object of the present invention therefore is to provide an exercise device having longer handlebars of an appropriate length to drive the pedals so as to assist both hands of a user in attaining a better coordination of movements.

These and other objects will be apparent to those skilled in the art from the following description taken in conjunction with the drawing wherein:

DETAILED DESCRIPTION OF THE PREFERRED EMBODIMENT

Figure 1:
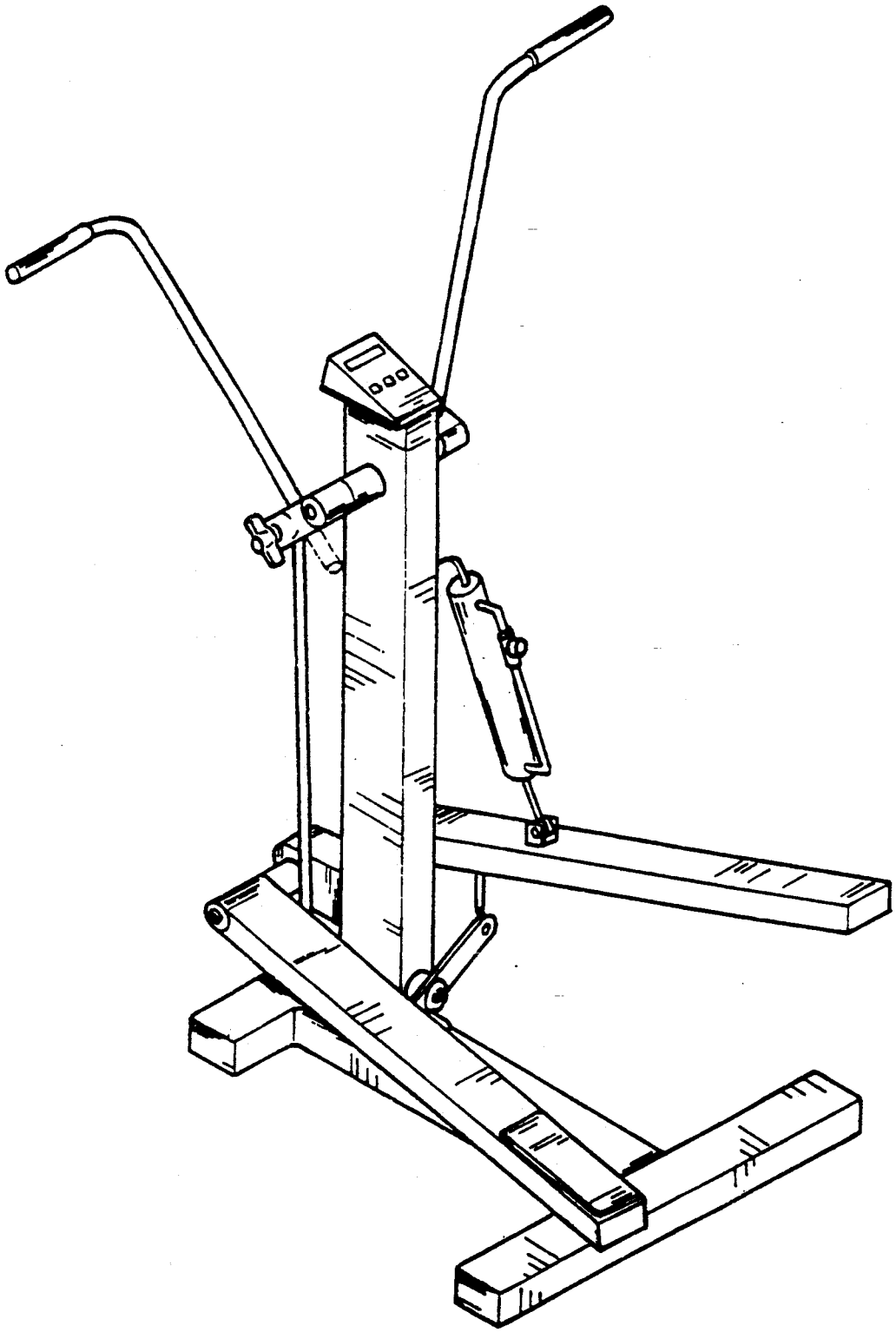
FIG. 1 (PRIOR ART)
FIG. 1 is a perspective view of U.S. Pat. No. 4,934,690.
Figure 2:
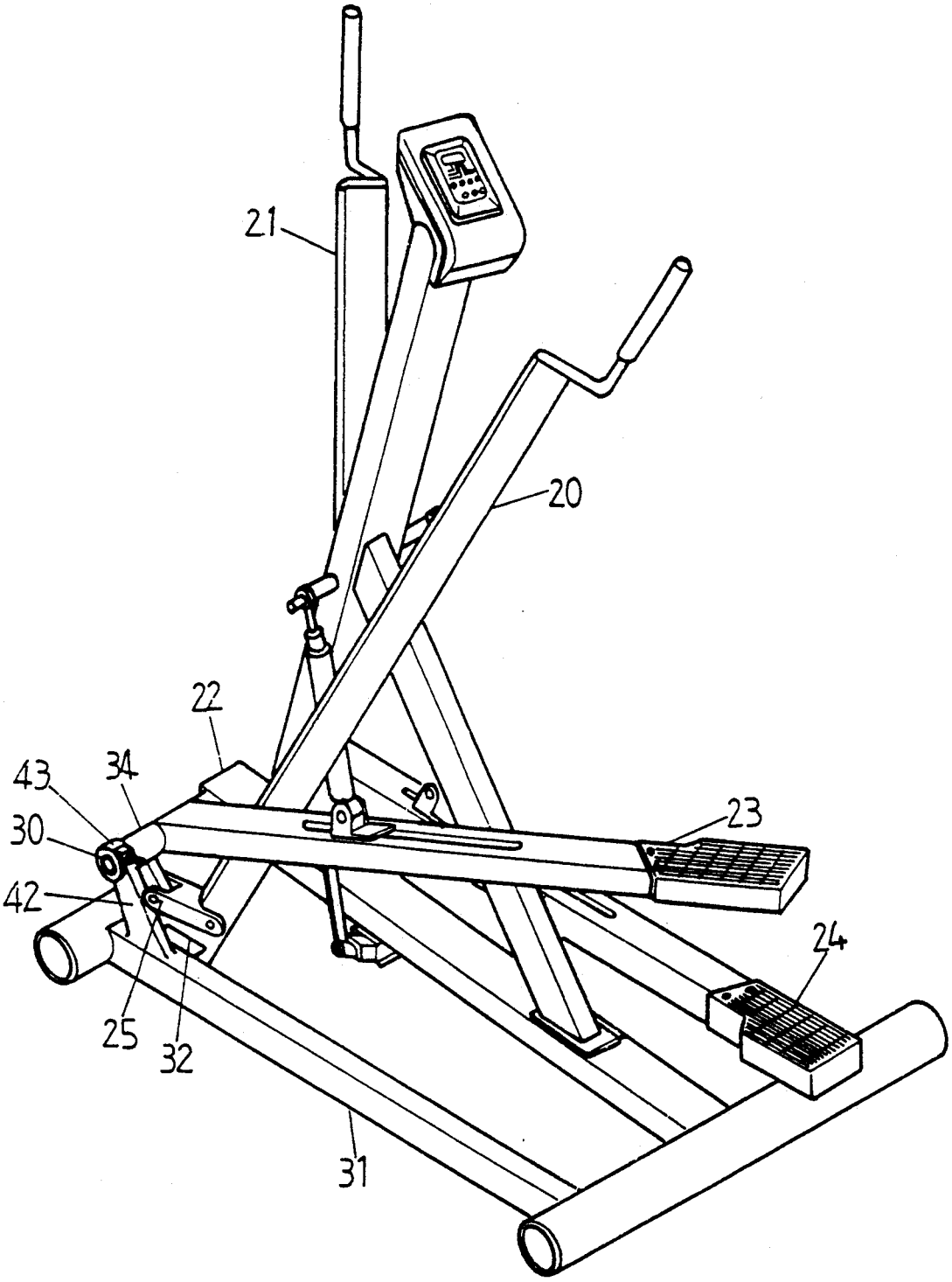
FIG. 2 is a assembled view of an exercise device according to the present invention.
Figure 3:
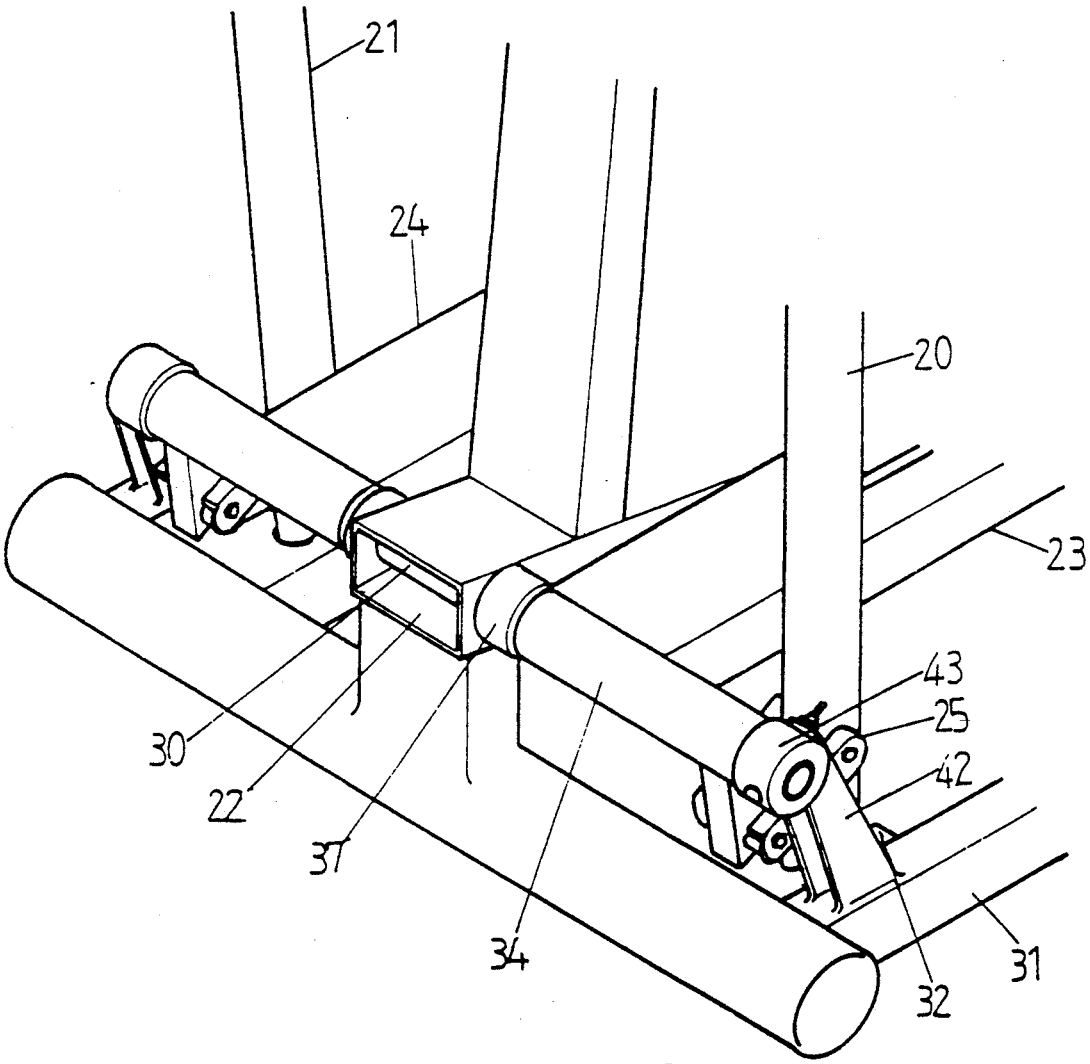
FIG. 3 is an enlarged detailed view of the device shown in FIG. 2.
Figure 4:
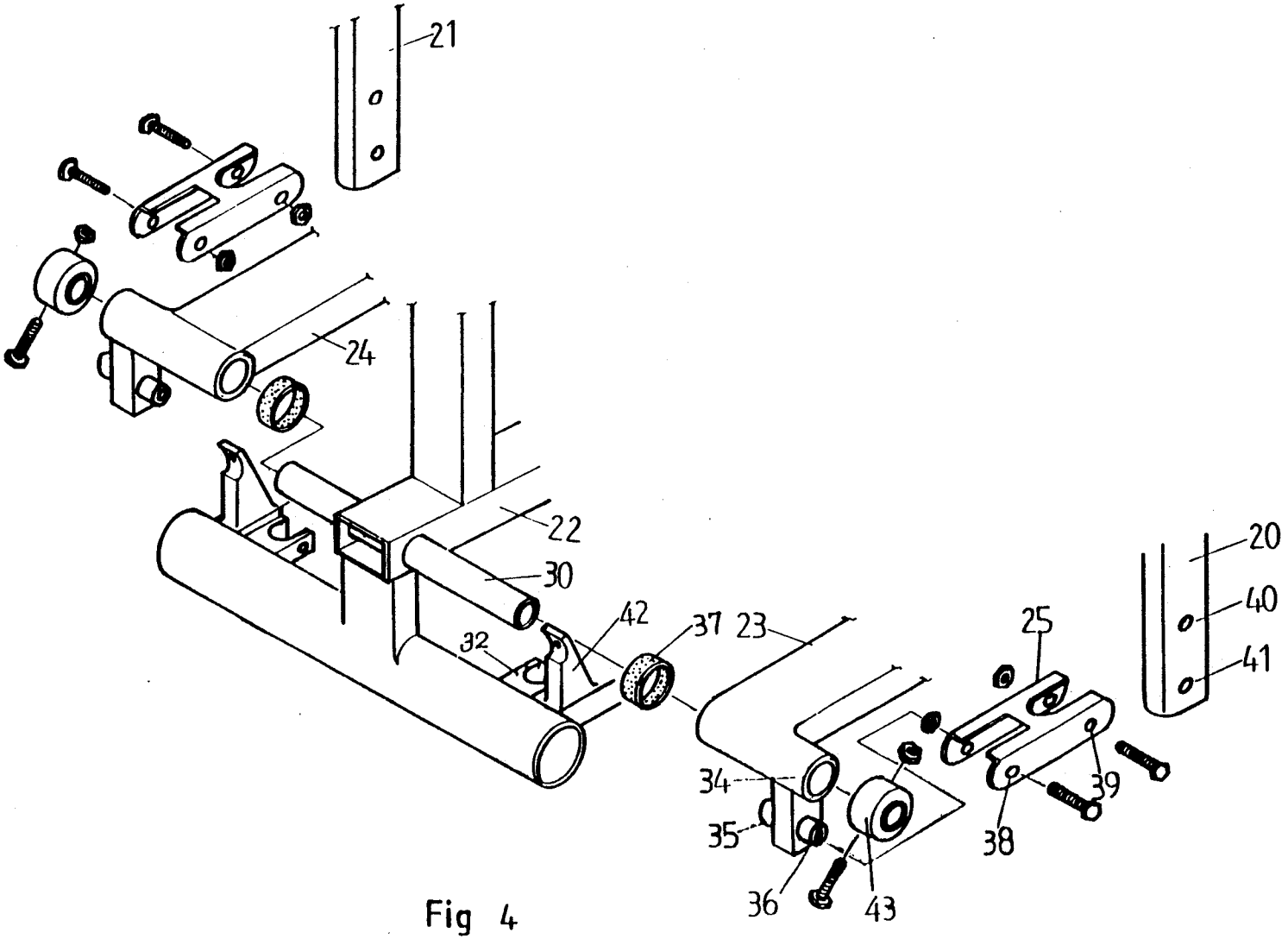
FIG. 4 is an exploded view of the device shown in FIG. 2.
Figure 5:
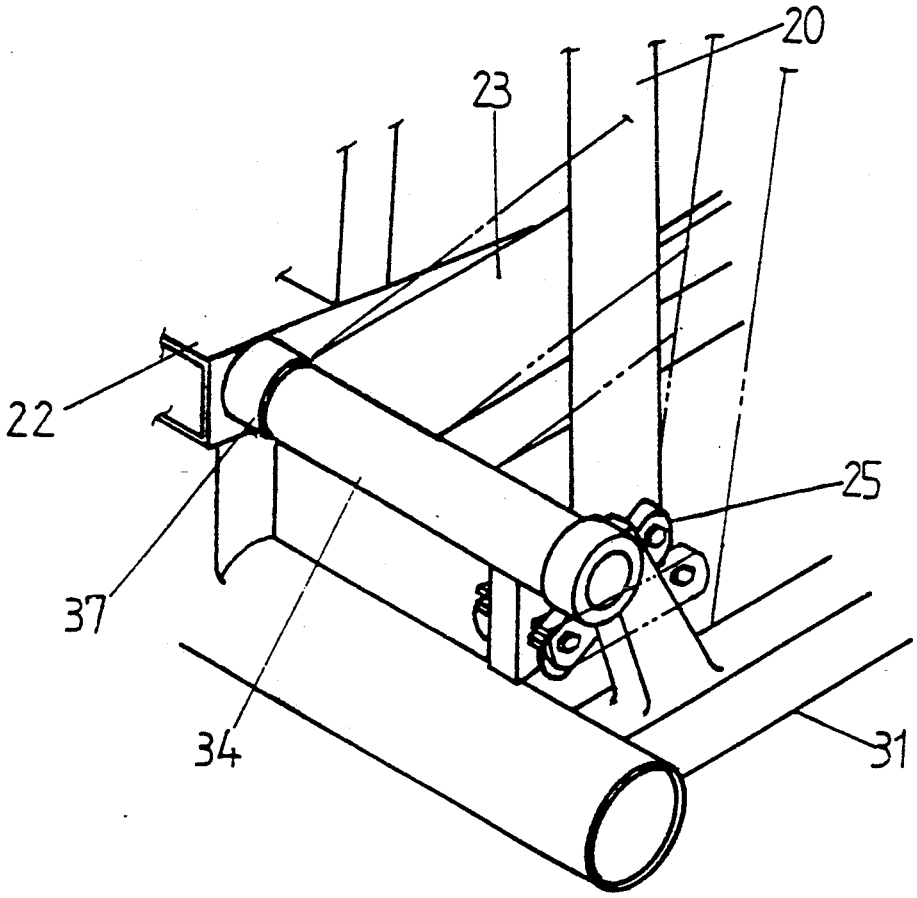
FIG. 5 is a schematic view showing an exercise device in FIG. 2 in operation.

Referring now to FIGS. 2-5, the embodiment of the present invention is shown comprising mainly two driving handlebars 20 and 21, a base seat 22, two pedals 23 and 24, and a connector 25. A set shaft 30 is welded to the base seat 22. A pivotal seat 32 is arranged under the base seat 22 and has a slot 33 disposed thereon. A positioning block 42 is arranged separately on inner side of both ends of support frame 31. A sleeve 34 is disposed in front of the pedals 23 and 24. A connector 35 is fastened to the lower end of the sleeve 34 and has a connecting hole 36 disposed thereon. The sleeve 34 of the pedal is coupled with set shaft 30. A rubber ring 37 is lodged at the front end of the sleeve 34 of set shaft 30. The rear end of the sleeve 34 of set shaft 30 is coupled with a connecting block 43, which in turn is fixed to the positioning block 42. The connector 25 is of an H-shaped construction and has a U-shaped groove and connecting holes 38 and 39 disposed at both front and rear ends thereof for accommodating bolts to hinge the connecting piece 35 located at lower and of the pedal sleeve 34 and the connecting hole 40 located at the lower end of the handlebars 20 and 21. The connecting hole 41 located at lower end of handlebars 20 and 21 is hinged to the connecting holes 44 of pivotal seat 32 located under the base seat 22. The assembled embodiments of this invention are shown in FIGS. 2 and 3. In the course of operation, the pivotal seat 32 serves as a fulcrum to activate the connector 25 and the sleeve 34 when the handlebars 20 and 21 are pulled by a user. In the meantime, the pedals 23 and 24 are subsequently activated.

The advantages of this invention over the prior art have become apparent. The handlebars of this invention have been lengthened in such a way that they provide a user with a greater maneuverability and a better coordination of movements of both hands.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. A driving mechanism of an exercise device comprising:

a base an upright frame, seat, with a set shaft welded thereto and a pivotal seat disposed thereunder, said pivotal seat having connecting holes and a slot disposed thereon, said base seat having a support frame attached to both ends thereof, said support frame having a positioning block arranged thereon;

two pedals having sleeves disposed at front ends thereof, said sleeves having connecting pieces fixed thereto, said connecting pieces having connecting holes disposed thereon, said sleeve being rotatably fixed to said set shaft having a front end to which a rubber ring is arranged and a rear end to which a connecting block is attached, said connecting block being fixed to said positioning block a pair of resistance means attached between said frame and a said respective pedal;

a connector of H-shaped construction having connecting holes disposed at both front and rear ends thereof said connector pieces hinged to said H-shaped connector by bolts through said front connecting holes of said H-shaped connector and said connection holes of said connecting pieces; and a U-shaped groove disposed thereon;

upper and lower handlebars having two connecting holes disposed at the lower end thereof; said handlebars hinged to said H-shaped connection by bolts through said rear connecting holes of said H-shaped connection, and said upper connection holes of said handlebars; said handlebars hinged in said slot to said pivotal seat by bolts through said lower connecting holes of said handlebars and said connecting holes of said pivotal seat; whereby when a user stands on said pedals and grips the handlebars, an exercise of the user's legs with the synchronized motion of the user's arms is achieved.

* * * * *